United States Patent [19]

Hwang

[11] Patent Number: 4,931,029

[45] Date of Patent: Jun. 5, 1990

[54] MUSICAL TOY TUMBLER

[75] Inventor: Long-Shi Hwang, Taichung Hsien, Taiwan

[73] Assignee: Kyooh Precision Industry Co., Ltd., Taipei, Taiwan

[21] Appl. No.: 325,366

[22] Filed: Mar. 20, 1989

[51] Int. Cl.[5] ..... A63H 15/06; A63H 5/00

[52] U.S. Cl. ..... 446/396; 446/175; 446/397; 446/484

[58] Field of Search ..... 446/175, 397, 303, 297, 446/484, 396, 325, 326; 84/94.2

[56] References Cited

U.S. PATENT DOCUMENTS

| | | | |
|---|---|---|---|
| 2,611,214 | 9/1952 | Schur | 446/325 |
| 3,341,968 | 9/1967 | Suchowski | 446/396 |
| 4,652,980 | 3/1987 | Segan | 84/94.2 X |
| 4,737,134 | 4/1988 | Rumsey | 446/175 X |

*Primary Examiner*—Mickey Yu

*Attorney, Agent, or Firm*—Asian Pacific Int'l. Patent & Trademark Office

[57] ABSTRACT

Th present invention is related to a modification made on a regular toy tumbler to let the toy tumbler be equipped with a sound generating IC controlled by a plate spring type microswitch. When the toy tumbler stands still, the microswitch is OFF, and no sound is generated. When the toy tumbler is rocking, the microswitch is ON, and the sound generating IC is triggered to provide audio signal through an electronic speaker. Matching with the innovative outer appearance, the toy tumbler is bestowed with a new life.

1 Claim, 5 Drawing Sheets

MUSICAL TOY TUMBLER

BACKGROUND OF THE INVENTION

Due to fast industrial development advanced technology has been widely applied in all areas. In consequence, traditional toys are losing their attractiveness to children, and sound and light generating toys are gradually taking the place of the traditional toys. However, traditional toys may be modified to have a new life so as to attract the children again.

Regular toy tumblers are designed to have a heavy bottom so as to lower the center of gravity. Therefore, while rocking, a toy tumbler always keeps a vertical posture. This simple arrangement can no longer attract people's attention. This invention seeks to apply modern electronic technology to a traditional toy tumbler to let the toy tumbler play music while rocking.

SUMMARY OF THE INVENTION

The present invention is related to a musical toy tumbler and, more particularly to a toy tumbler which includes a music IC controlled by a micro-switch mounted on the bottom of the toy tumbler so as to play pre-programmed music while rocking.

BRIEF DESCRIPTION OF THE DRAWINGS

FIG. 2-1 is a sectional view of the second embodiment (photoelectric induced) of the present invention.

FIG. 3-1 is a sectional view of the retainer elements used in the FIG. 3 structure.

FIG. 4-1 is an enlarged fragmentary view of a microswitch mechanism employed in the FIG. 2 structure.

FIG. 4-2 illustrates the microswitch mechanism when the associated toy tumbler is rocking.

FIG. 4-3 illustrates the rocking motion of the structure shown in FIG. 2-1.

DETAILED DESCRIPTION OF THE PREFERRED EMBODIMENTS

Figure 1:
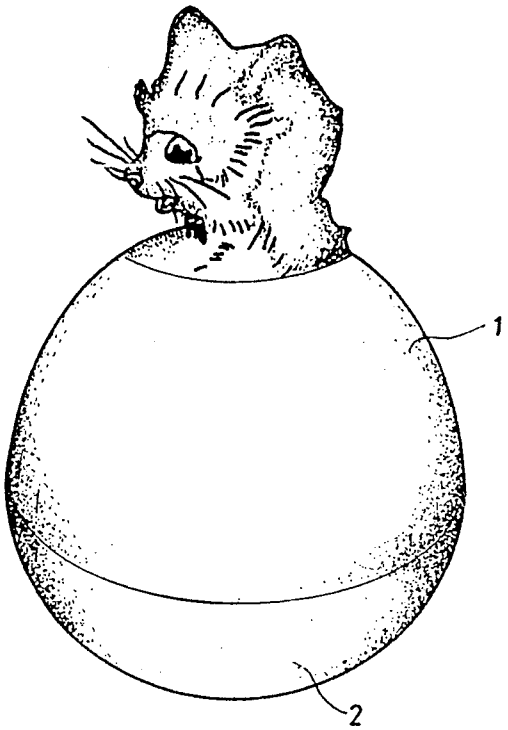
FIG. 1 illustrates a toy tumbler constructed according to the present invention.
Figure 2:
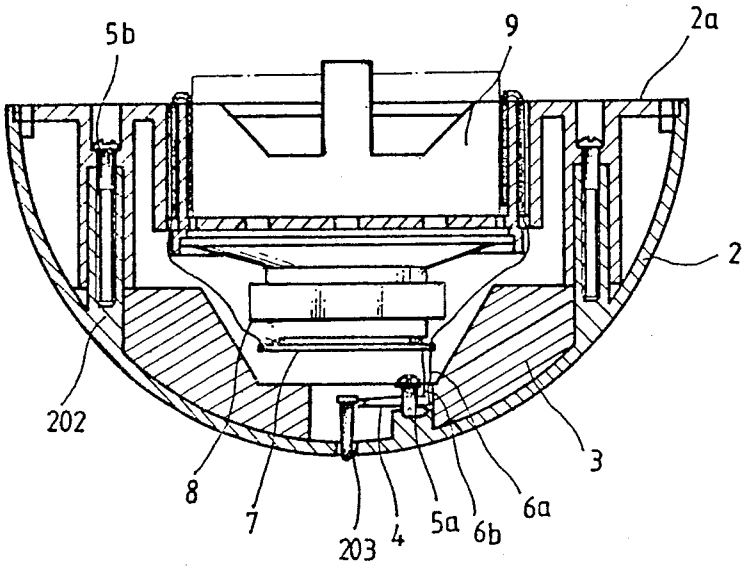
FIG. 2 is a sectional view of the first embodiment of the present invention.
Figures 1, 2:
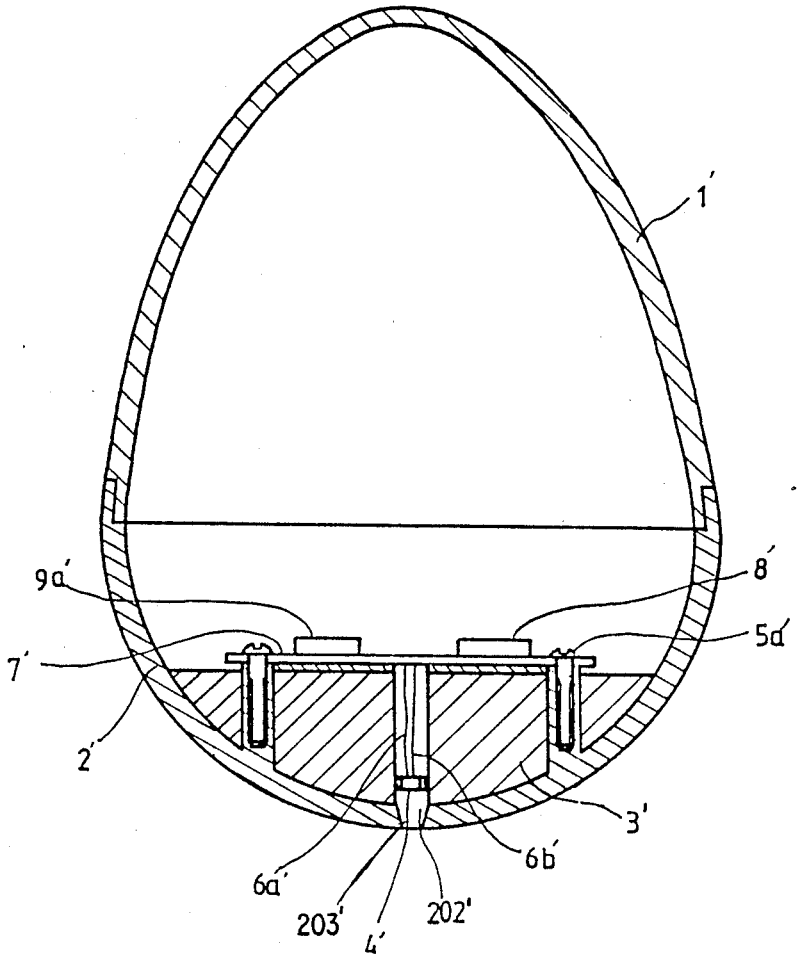

Referring to FIG. 1, a musical toy tumbler may have any diversified outer appearance to make it more attractive, cute and beautiful. In this embodiment, the musical toy tumbler is comprised of an upper casing 1 and a bottom casing 2. Referring to FIG. 2, the bottom casing 2 includes three internally threaded tubes 202. The center of gravity of this embodiment is located at the bottom of the bottom casing 2. A round hole 203 is made at the bottom of the bottom casing 2 at the central portion thereof. A heavy element 3 in a relatively small size is set in the inner bottom of the bottom casing 2, comprising a rectangular slot at the bottom portion with a plate spring type microswitch 4 set therein. The microswitch 4 is fixedly attached to the bottom casing 2 by means of a screw 5*a*, and is connected with two conductive wires 6*a* and 6*b* to further connect to a circuit board 7. The circuit board 7 is fixedly attached to the bottom surface of an electronic sound generating speaker 8 by means of a double-side adhesive cellophane tape. The electronic sound generating speaker 8 is fixedly attached to the bottom surface of a cover plate 2*a*. The cover plate 2*a* is fixedly attached to the bottom casing 2 at the top.

There are provided three screws 5*b* to respectively screw into the three internally threaded tubes 202 of the bottom casing so as to let the bottom casing 2, the heavy element 3 and the cover plate 2*a* be screwed up into a unit.

In conventional toy tumblers, a relatively large size heavy element is required. According to the present invention, a relatively very small heavy metal block 3 is provided to match with the gravity of the electronic sound generating speaker 8 and the battery in a battery chamber 9, such that the center of the gravity of the toy tumbler is lowered, and the toy tumbler will not fall while rocking.

Please refer to FIG. 2-1, which illustrates another embodiment of the present invention. In this embodiment, the heavy element 3' of the bottom casing 2' comprises a cylindrical hole 202' at the middle portion with a photoelectric element of negative coefficient of resistance 4' (for example, CDS) set therein. This photoelectric element 4' is connected to a circuit board 7' by means of two conductive wires 6*a'* and 6*b*. An electronic sound generating means 8' and a mercury cell 9*a'* are mounted on the circuit board 7'. The bottom casing 2 further comprises thereinside three elongated tubes extending through three round holes in heavy element 3. The heavy element 3 is set in the bottom casing 2 with the three elongated tubes of the bottom casing 2 respectively inserted into the three round holes of the heavy element 3. The circuit board 7' is fixedly attached to the bottom casing 2'. There are provided three screws 5*a'* to screw up the circuit board 7', the heavy element 3' and the bottom casing 2' into a consolidated unit. The bottom casing 2' also comprises a round hole 203' at the bottom center to aim at the cylindrical hole of the heavy element 3'. The photoelectric element 4' (for example, CDS) is retained by a sponge ring to further set in the cylindrical hole of the heavy element 3'. By means of this arrangement, the outside light penetrates through the bottom round hole 203' of the bottom casing 2' to drive the photoelectric element 4' to trigger the electronic loop of the circuit board 7' so as to further drive the electronic sound generating means 8' to provide an audio signal. The mercury cell ' provides the circuit board 7' with necessary working voltage. In order to prevent light penetration through the round hole 203' of the bottom casing 2' when the toy tumbler stands still, the round hole 203' is designed to have a wider caliber at the inner portion and a narrower caliber at the outer portion so as to define an inclined surface. By means of this special design, when the toy tumbler stands still, no light is permitted to penetrate through the round hole 203' of the bottom casing 2'. Therefore, error triggering of the inner circuit is prevented.

Figure 3:
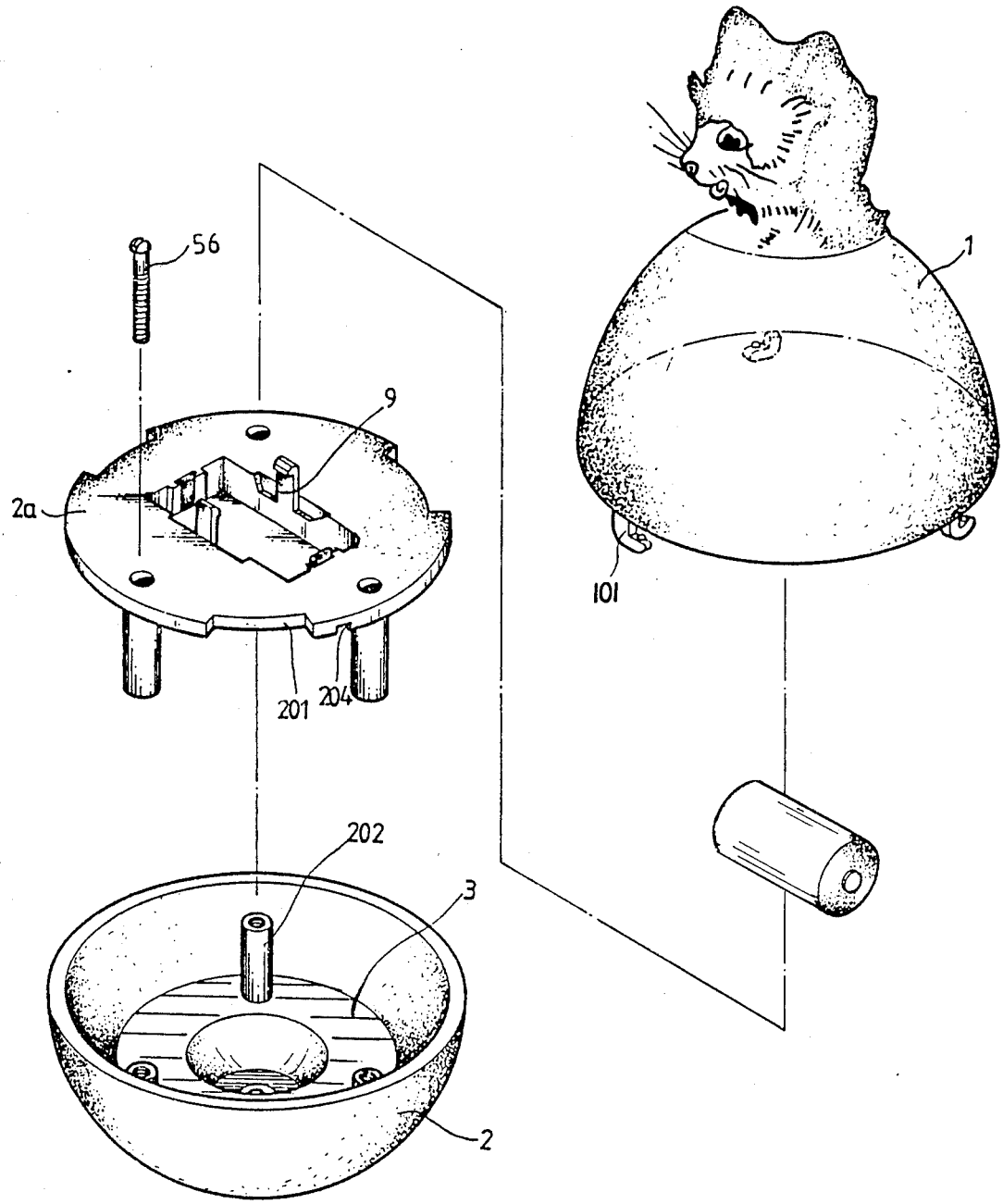
FIG. 3 is a fragmentary perspective view of the FIG. 1 structure.

Referring to FIG. 3, the cover plate 2*a* of the bottom casing 2 is arranged to provide a battery chamber 9 with a dry cell set therein to provide the circuit board with necessary working voltage. The upper casing 1 comprises three L-shaped retainer elements 101 having respectively a semi-circular front end. The bottom casing 2 comprises three rectangular slots 201 having respectively a biased recess at the bottom end. During assembly of the upper casing 1 and the bottom casing 2, the three retainer elements 101 of the upper casing 1 are respectively inserted into the three rectangular slots 201 of the bottom casing 2 to let the three semi-circular front ends of the three retainer elements 101 be respectively set in the three biased recesses of the three rectangular slots 201, such that the bottom casing 2 and the upper casing 1 are firmly connected together, as shown in FIG. 3-1. By means of said arrangement, the structure becomes easy to assemble or to detach for convenient replacement of dry cell, and consequently, the service life of the present invention can be extended.

Figures 3, 4:
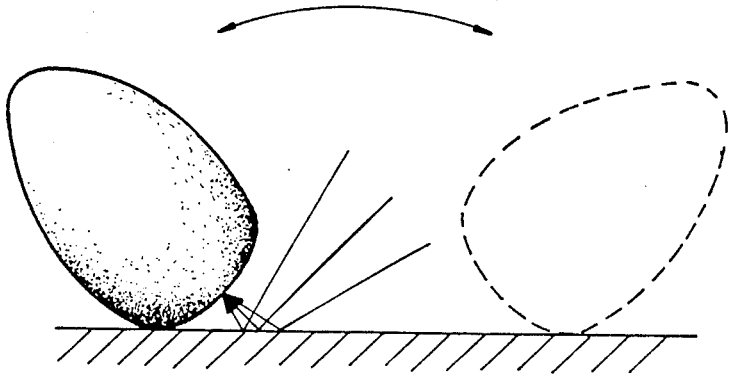
Figures 1, 3:
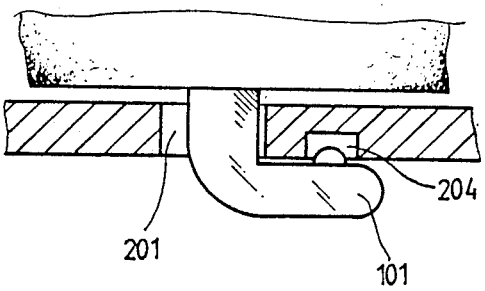
Figures 2, 4:
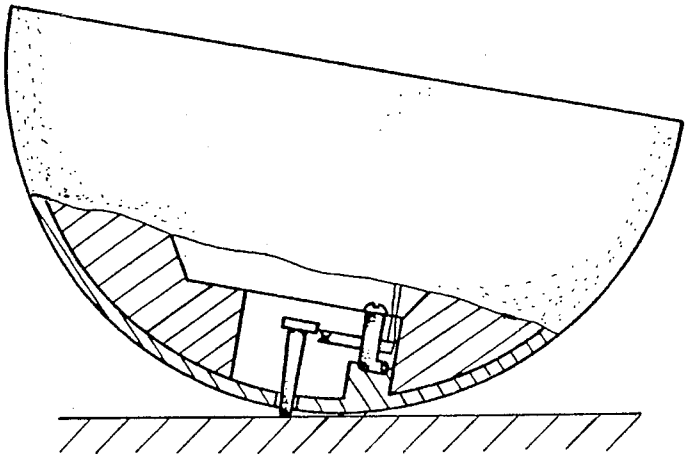
Figures 1, 4:
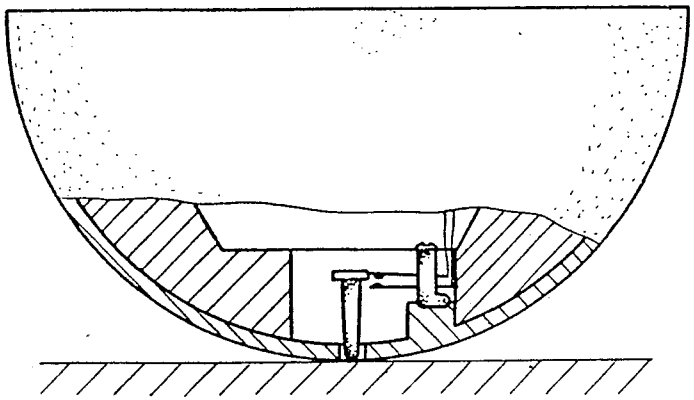

Referring to FIGS. 4-1 and 4-2 regarding the process of the sound generating circuit of the present invention during the rocking of the toy tumbler. As shown in FIG. 4-1, when the toy tumbler stands vertical, the tip of the plate spring type microswitch is drawing back inside the bottom casing. Therefore, the plate spring type microswitch is OFF, the sound generating element is not energized, and no sound is provided. As shown in FIG. 4-2, when the toy tumbler is rocking around, the tip of the plate spring type microswitch is extended outward. Therefore, the microswitch becomes ON, to trigger the sound generating circuit and the sound generating means of the circuit board so as to provide the pre-fixed audio signal. During rocking of the toy tumbler, the plate spring type microswitch is intermittently switched on and off. However, because the loop of the circuit board is specially designed to play music for one turn upon triggering, the intermittently switching on and off action of the microswitch does not interfere with the music play of the sound generating means. Until one turn of music play is completed, if the toy tumbler is still rocking around, the sound generating means will be triggered again to restart playing a music.

If a photoelectric element of the second embodiment of the present invention is applied, as shown in FIG. 4-3, when the toy tumbler stands still, the photoelectric element is protected from outside light. Therefore, the circuit board is turned off, and no sound is generated. When the toy tumbler is rocking around, the body of the toy tumbler is inclined to allow outside light to penetrate into the bottom round hole of the bottom casing so as to induce the photoelectric element to trigger the inner sound generating circuit and sound generating means. Therefore, a fixed music is played. The circuit board and the sound generating means may be designed to provide a music melody, animal's singing, synthesized human speech, or any other special electronic sounds. In the present invention, the circuit board and the sound generating means are designed to provide a synthesized human sound of laughter. When the toy tumbler is rocking, it produces a sound of laughter—"HA!" for each turn of rocking. The wider the oscillating range is, the longer the sound of laughter will be. At the end of the oscillating of the toy tumbler, the sound of laughter extends to the maximum extent, and finally, the sound stops while the toy tumbler stops oscillating. The circuit may be easily designed to provide different sound effects. For example, one turn of rocking of the toy tumbler is arranged as a cycle of a sound of laughter. At the initial stage, the intensity of the sound reaches to the maximum, and the sound of laughter is not interrupted, and thereafter, the intensity of the sound is gradually reducing. When the toy tumbler rocks to the other side, the continuous sound of laughter is repeated.

In general, as described above, the present invention is to provide a kind of toy tumbler which has diversified outer appearance and which is arranged to produce a diversified sound while rocking.

I claim:

1. A musical toy tumbler comprising an upper casing and a bottom casing releasably joined together on a horizontal interface plane; said bottom casing including a bottom wall having an external curvilinear surface that is rounded in every direction whereby the toy tumbler can roll in any direction in response to manual force thereon; said bottom casing having a vertical central axis; an annular weight member seated on said casing bottom wall in concentric relation to the casing central axis, said weight member having an upper face extending generally normal to the casing central axis; internally threaded anchor elements (202) extended upwardly from the casing bottom wall at points spaced radially outward from the casing central axis; a cover member (2*a*) overlying said weight member, said cover member having a number of positioner sleeve elements encircling said anchor elements; said positioner elements having lower ends abutting against the upper face of the weight member; screws (5*b*) extending through the cover member into the threaded anchor elements to retain the cover member and weight member in said bottom casing; a hollow receptacle structure extending downwardly from a central point on said cover member for containment of at least one dry cell battery; said hollow receptacle structure comprising a flat wall extending across the casing central axis a slight distance above the weight member; said weight member having a centrally located recess in its upper face; an electronic sound generating speaker (8) located within said recess, said speaker including an upwardly facing horn structure secured to the lower face of said flat wall; said flat wall having at least one opening therethrough for transmitting sonic energy from the speaker; and means located on the casing central axis below the aforementioned speaker for operating the speaker in response to rolling motion of the toy tumbler.

* * * * *